US007615161B2

(12) United States Patent
Hoffman

(10) Patent No.: US 7,615,161 B2
(45) Date of Patent: Nov. 10, 2009

(54) SIMPLIFIED WAY TO MANUFACTURE A LOW COST CAST TYPE COLLIMATOR ASSEMBLY

(75) Inventor: David Michael Hoffman, New Berlin, WI (US)

(73) Assignee: General Electric Company, Schenectady, NY (US)

( * ) Notice: Subject to any disclaimer, the term of this patent is extended or adjusted under 35 U.S.C. 154(b) by 234 days.

(21) Appl. No.: 11/161,867

(22) Filed: Aug. 19, 2005

(65) Prior Publication Data

US 2007/0041505 A1 Feb. 22, 2007

(51) Int. Cl.
*G21K 1/02* (2006.01)
*C25F 3/00* (2006.01)

(52) U.S. Cl. ..... 216/12

(58) Field of Classification Search ..... None
See application file for complete search history.

(56) References Cited

U.S. PATENT DOCUMENTS 4,183,664 A * 1/1980 Rambauske ..... 356/3.14
4,258,468 A * 3/1981 Balde ..... 29/830
4,780,395 A * 10/1988 Saito et al. ..... 430/315
5,086,248 A * 2/1992 Horton et al. ..... 313/103 CM
5,268,068 A * 12/1993 Cowell et al. ..... 216/12
5,546,486 A * 8/1996 Shih et al. ..... 385/31
5,569,355 A * 10/1996 Then et al. ..... 438/20
5,599,413 A * 2/1997 Nakao et al. ..... 156/89.12
5,606,589 A 2/1997 Pellegrino et al. ..... 378/154
5,857,883 A * 1/1999 Knickerbocker et al. ..... 445/23
5,997,713 A * 12/1999 Beetz et al. ..... 205/124
6,185,278 B1 2/2001 Appleby et al. ..... 378/149
6,317,175 B1 * 11/2001 Salerno et al. ..... 349/45
6,509,687 B1 * 1/2003 Natarajan et al. ..... 313/495
6,558,770 B1 * 5/2003 Lehmann et al. ..... 428/138
6,649,914 B1 * 11/2003 Moorman et al. ..... 250/363.06
6,711,200 B1 * 3/2004 Scherer et al. ..... 372/64
6,976,956 B2 * 12/2005 Takahashi et al. ..... 600/166
7,139,459 B2 * 11/2006 Kochergin et al. ..... 385/128
7,426,040 B2 * 9/2008 Kim et al. ..... 356/519
2002/0074522 A1 * 6/2002 Zakar ..... 250/495.1
2003/0002809 A1 * 1/2003 Jian ..... 385/73
2004/0004779 A1 * 1/2004 Kochergin et al. ..... 359/885
2004/0150896 A1 * 8/2004 Yamada et al. ..... 359/796
2005/0058414 A1 * 3/2005 Kochergin ..... 385/120
2005/0161589 A1 * 7/2005 Kim et al. ..... 250/216
2005/0191016 A1 * 9/2005 Ishikawa et al. ..... 385/115
2006/0209413 A1 * 9/2006 Kim et al. ..... 359/577
2007/0181821 A1 * 8/2007 Pinchot ..... 250/397
2008/0279558 A1 * 11/2008 Capron et al. ..... 398/118

* cited by examiner

*Primary Examiner*—Allan Olsen
(74) *Attorney, Agent, or Firm*—Cantor Colburn LLP

(57) ABSTRACT

A method of fabricating a collimator assembly includes attaching a first layer to a second layer and forming channels through the attached first layer and second layer. Openings are disposed in the first and second layers before attaching the first and second layers. The openings of the first and second layers are aligned before forming the channels. Forming channels includes removing material of the first layer, the second layer or both layers. The attachment of the first and second layers defines an overall thickness of the collimator assembly. A thickness of the first layer ranges from about 5% to about 10% of the overall thickness.

19 Claims, 4 Drawing Sheets

SIMPLIFIED WAY TO MANUFACTURE A LOW COST CAST TYPE COLLIMATOR ASSEMBLY

BACKGROUND OF THE INVENTION

The invention relates generally to apparatus for high energy imaging and other radiation imaging systems, and more particularly, a collimator apparatus and fabrication process.

Radiation imaging systems are widely used for medical and industrial purposes, such as for x-ray computed tomography (CT) for example. In a CT system, an x-ray source projects a fan-shaped beam that is collimated to lie within an X-Y plane of a Cartesian coordinate system, termed the "imaging plane." The x-ray beam then passes through the object being imaged, such as a medical patient, and impinges upon a multi-row multi-column detector array.

Some CT systems utilize CT detectors with collimators fabricated from individual high density, high atomic number plates, like tungsten plates, and high density, high atomic wires at ninety degree angles to the plates. The plates function to eliminate scattered x-rays that compromise CT image quality.

Tungsten plates in the collimator assembly have dimensions of up to 200 microns in width. This width represents more material than is required for just the collimation of scattered x-rays. The width dimension is needed however, for the collimator's second function, the shielding of the scintillator edges, shielding of the reflector material and shielding of the photodiode. The collimator assembly is also designed with a high aspect ratio, height (or overall thickness in the y-direction) to length (or overall spacing in the X-direction), for the efficient collimation of scattered radiation. This aspect ratio results in a larger depth (in the y-direction) for x-ray penetration shielding than is required.

CT detectors also use reflectors that are composed of organic reflector composites which are formed in gaps between the scintillators. Reflectors are composed of organic reflector composites or are made of layers, where one layer is lead or some other highly x-ray absorbing material. These reflectors do, at best, a modest job in attenuating scattered x-rays. Composite structures of the reflectors present challenges in manufacturing and lending themselves to small cells with small gaps. Alternatives to these constructions have been found in high x-ray attenuating pigments in organic reflector composites, but these present their own challenges in attenuating scattered x-rays. These challenges arise from the maximum amount of attenuating pigment that can be loaded into into the organic reflector composite and the impact on overall reflector reflectivity.

Accordingly, there is a need for a collimator assembly that provides improved manufacturability and costs, and allows separation of the collimator functions into scatter collimation and x-ray shielding, which in turn, allows individual optimization of each function, improving overall detector performance.

SUMMARY OF THE INVENTION

A method of fabricating a collimator assembly in accordance with an exemplary embodiment is provided. The method includes attaching a first layer to a second layer and forming channels through the attached first layer and second layer. The attachment of the first and second layer defines an overall thickness of the collimator assembly. A thickness of the first layer ranges from about 5% to about 10% of the overall thickness.

A method of manufacturing a collimator assembly for use with a high energy imaging system in accordance with another exemplary embodiment is provided. The collimator assembly includes an external layer and an internal layer. The method includes configuring holes in the external layer and the internal layer. Subsequent to configuring the holes, the external layer is joined to the internal layer. Part of the internal layer is removed via the holes of the external layer after the two layers are joined. The removing of part of the internal layer forms passages through the external layer and the internal layer.

BRIEF DESCRIPTION OF THE DRAWINGS

Referring to the exemplary drawings wherein like elements are numbered alike in the accompanying Figures.

DETAILED DESCRIPTION OF THE DRAWINGS

Embodiments of the invention provide a multiple part collimator assembly for use within a high energy imaging system, such as a multi-slice computed tomography (CT) x-ray detector used in medical applications. Industrial applications that operate with high energy systems may include, X-ray projection detectors, Nuclear gamma camera detector and baggage scanning detectorsc. While embodiments described herein depict x-rays as exemplary ionizing radiation, it will be appreciated that the disclosed invention may also be applicable to other high energy ionizing radiation, such as gamma rays, high energy electron (beta) rays, or high energy charged particles (such as those encountered in nuclear physics and space telescopes), for example. As such, the high atomic number, high density materials described herein for use with x-rays as the exemplary ionizing radiation may also be used for the other high energy ionizing radiation applications discussed above. Accordingly, the disclosed invention is not limited to embodiments of x-ray detection or medical applications.

In exemplary embodiments according to an embodiment of the invention, the collimator assembly may include a "thin" first layer and a "thick" second layer joined together. The first layer, including precisely formed holes, may essentially be used as a mask to remove material in roughly formed openings of the second layer. Finished channels extending through the joined first and second layers are formed from this removing of the material.

Figure 1:
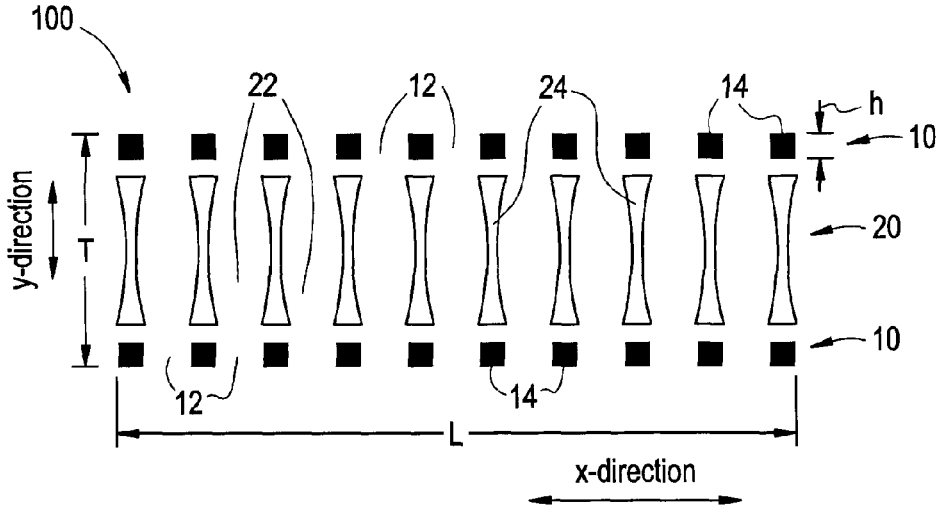
FIG. 1 depicts a cross-sectional view of an exemplary embodiment of a collimator assembly according to an embodiment of the invention.

FIG. 1 is an exemplary embodiment of a collimator assembly 100 according to an embodiment of the invention. The collimator assembly 100 includes two of a first layer 10 disposed on opposing faces of a second layer 20. In alternative embodiments, one of the first layer 10 may be attached to the second layer 20 or more than two of the first layer 10 or the second layer 20 may be attached to each other.

As used herein, the term "overall thickness" refers to the thickness "T" of a complete collimator assembly regardless of the number of the first layer 10 or of the second layer 20 it has. FIG. 1 depicting two of the first layer 10 and one of the second layer 20 is presented for illustration purposes only.

In an exemplary embodiment, the first layer 10 may range from a thickness "h" (in the y-direction) of about 5% to about 10% of the overall thickness of the collimator assembly 100. In alternative embodiments, the first layer 10 may have a thickness "h" preferably approximately 5% or no more than 10% of the overall thickness. In exemplary embodiments where there may be more than one of the first layer 10, the layers may be of equal thicknesses, or may be different thicknesses as depicted in the exemplary embodiment of FIG. 8. Generally speaking, and in a relative sense, the first layer 10 may be considered "thin" in the y-direction, or the direction of the x-ray. Conversely, the second layer 20 may be considered "thick" in the y-direction, or in the direction of the x-ray with regard to the overall thickness of the collimator assembly 100.

In exemplary embodiments, the collimator assembly 100 overall thickness "T" ranges from about 1 centimeter to about 6 centimeters. The collimator assembly 100 length "L", in a x-direction, substantially perpendicular to the thickness, may be approximately 0.5-2 meters. In alternative embodiments the collimator assembly 100 may be manufactured in sections, the sections assembled to achieve the overall length.

In comparison to other collimator assemblies with higher aspect ratios (y-direction/x-direction ratio) as discussed earlier, the collimator assembly 100 of the present invention provides a penetration direction depth that is equally suited for effective shielding of the scintillator, reflector or photodiodes of a CT system because the total amount of shielding in current CT detector collimators is far greater than is required.

Figure 2:
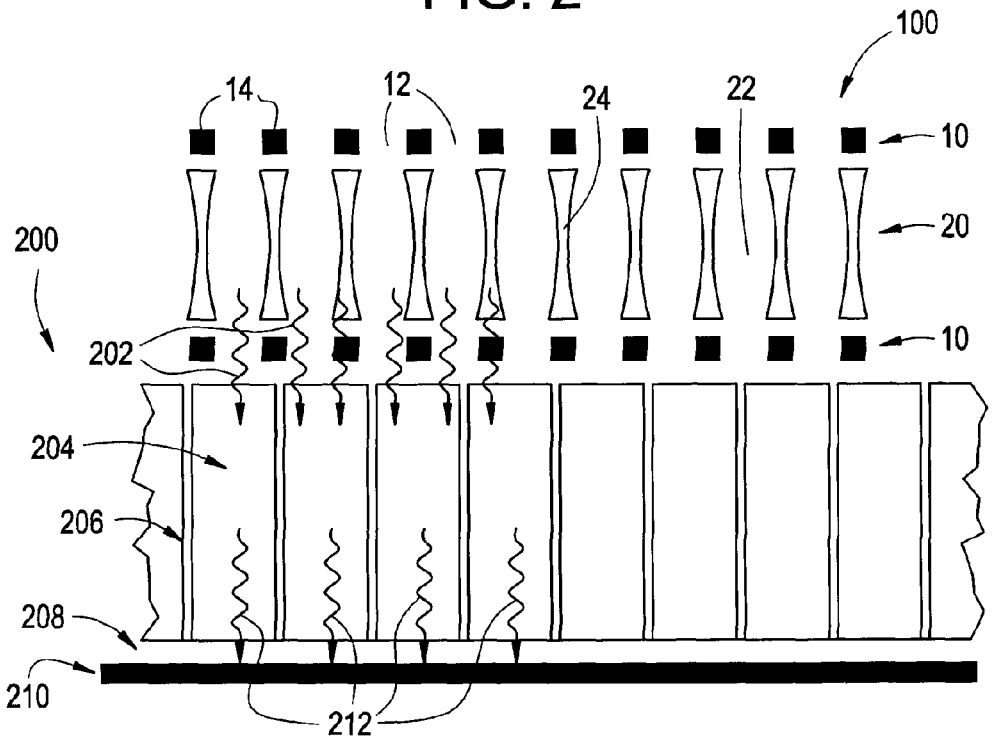
FIG. 2 depicts an exemplary embodiment of a cross section of a CT detector module including a collimator assembly according to an embodiment of the invention.

FIG. 2 illustrates an exemplary embodiment of a CT Detector Module 200 including a collimator assembly 100. Referring to FIG. 2, non scattered x-rays 202 are shown passing through the collimator assembly 100. The x-rays 202 are transmitted in the x-ray direction to a scintillator array 204 having reflectors 206 between panels of the scintillator array 204. An optical coupler 208, including a photodiode 210 then receive the scintillator light photons 212. As a result of the scintillator array 204, the optical coupler 208 and the photodiode 210, ionizing radiation is converted to light energy and then to electrical signals representative of the impinging ionizing radiation.

Figure 3:
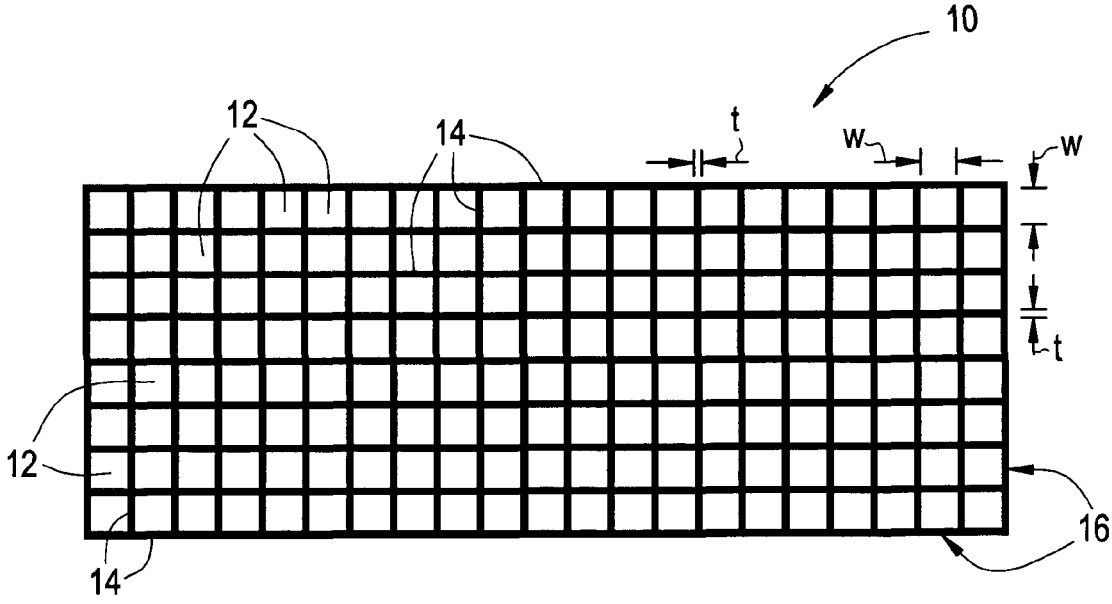
FIG. 3 depicts a top view of an exemplary embodiment of a first layer of a collimator assembly according to an embodiment of the invention.
Figure 4:
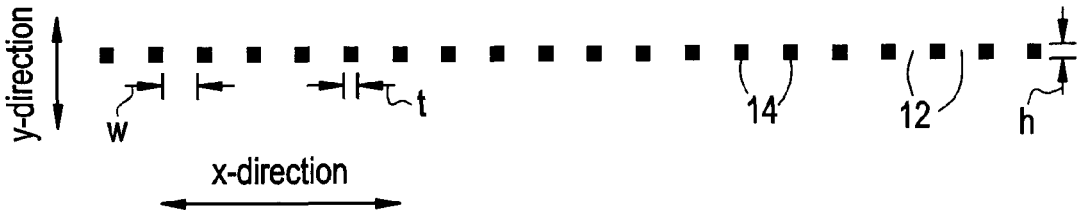
FIG. 4 depicts a cross-sectional view of the first layer of FIG. 3.

An exemplary embodiment of the first layer 10 of a collimator assembly 100 according to an embodiment of the invention is shown in FIGS. 3 and 4. Here, the first layer 10 is shown in a grid-like configuration, however, it will be appreciated that the grid-like configuration is for illustration purposes only and that any configuration suitable for the purposes disclosed herein may be employed for the first layer 10. The grid 10 includes borders 14 arranged in a rectilinear pattern, substantially perpendicular to the outer edges 16 of the grid 10. In alternative embodiments, the borders 14 may be configured in any of a number of patterned configurations, including, but not limited to, a substantially diagonal configured pattern in relation to the outer edges 16 of the grid 10.

In exemplary embodiments, a dimension "t" of the borders 14 may range from about 10 microns (μm) to about 500 microns (μm). In other exemplary embodiments, "t" may range from about 25 $\mu m^2$ to about 20 $\mu m^2$. In other exemplary embodiments, "t" may range from about 50 μm to about 200 μm. In yet other exemplary embodiments, "t" may range from about 50 μm to about 100 μm. Referring to FIGS. 3 and 4, the borders 14 include approximately the same dimension "t" across the first layer 10. However, in alternative embodiments, "t" may vary across the first layer 10. In exemplary embodiments, the accuracy of dimension "t" may range from about +2 um to about +5 Gum.

The borders 14 of the grid 10 shown in FIG. 3, create openings 12 between the borders 14. Referring to FIG. 3, the openings 12 of grid 10 are substantially square-shaped and approximately the same size, however, it will be appreciated that the square-like configuration is for illustration purposes only and that any configuration suitable for the purposes disclosed herein may be employed for the openings 12 of the first layer 10. For example, the openings 12 may be formed in other shapes, including, but not limited to, rectilinear, hexagonal, octagonal, round, elliptical and the like. The openings 12 may also be all of the same size or of varying sizes across the first layer 10.

The openings 12 of the exemplary embodiment of the first layer 10 shown in FIG. 3 may be considered "finished" or "precise," as the edges of the borders 14 are substantially even and smooth. Further explanation, including forming these "finished" openings 12 in the first layer 10 will be later discussed in more detail.

The openings 12 of grid 10 in FIG. 3 are shown arranged in columns and rows with regard to the outer edges 16 of the grid 10, however, it will be appreciated that the column and row configuration is for illustration purposes only and that any configuration suitable for the purposes disclosed herein may be employed for the arrangement of the openings 12 of the first layer 10. For example, in alternative embodiments, the openings 12 may be any of a number of patterned configurations, including, but not limited to, a substantially diagonal pattern.

In another exemplary embodiment, a ratio of dimension "h" of the openings 12 to a dimension "w" of the openings 12 may range from about a 1:1 to about a 1:4. In other exemplary embodiments, the ratio "h/w" may range from about 1:2-1:4. In yet other exemplary embodiments, the ratio "h/w" may range from about 1:2-1:3. For example, the cross-sectional view of the exemplary embodiment in FIG. 4 shows the openings 12 "h" in a ratio to the opening 12 "w" of approximately 1:2.

As best shown in the exemplary embodiment of FIG. 3, corners of the openings 12 include an angle formed by substantially orthogonal borders 14, the corners being substantially at right angles. In alternative embodiments, the corners may include a radius. The exemplary embodiment of the first layer 10 in FIG. 4 best shows the borders 14 including edges at substantially right angles to each other, i.e., edges in the y-direction to the edges in the x-direction. In other alternative embodiments, the borders 14 may include chamfered edges.

In yet another exemplary embodiment, an area of the openings 12 (for example, $w^2$), may range from approximately 10 $microns^2$ ($\mu m^2$) to 500 $microns^2$ ($\mu m^2$). In other exemplary embodiments, the area of the openings may range from about 50 $\mu m^2$ to about 200 $\mu m^2$. In yet other exemplary embodiments, the ratio "h/w" may range from about 50 $\mu m^2$ to about 100 $\mu m^2$. In yet another exemplary embodiment, the accuracy of the center-to-center positional distance between the openings 12 may range from about +2 μm to about +50 μm.

Figure 5:
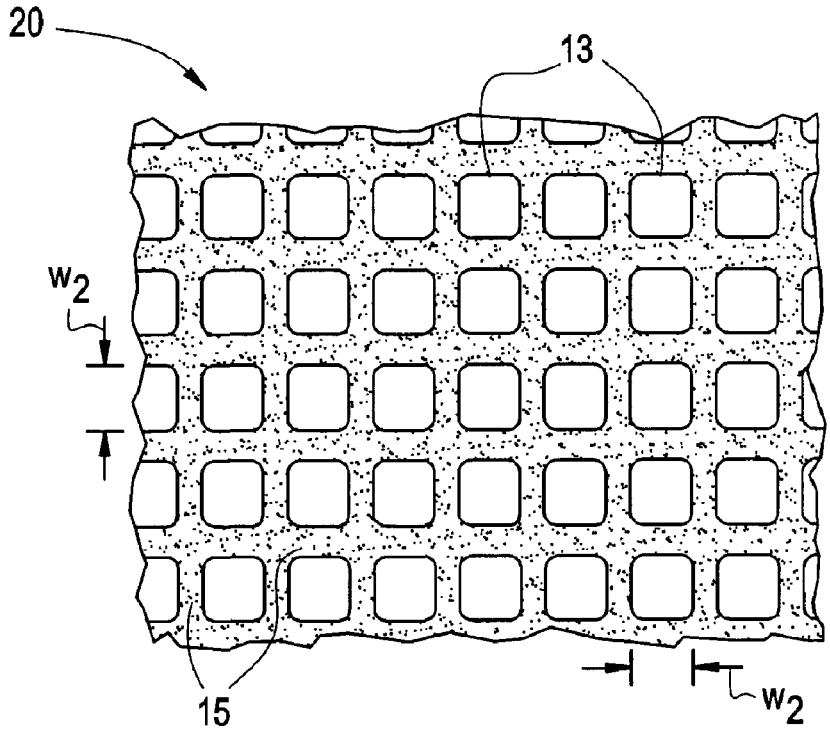
FIGS. 5 and 6 depict top views of exemplary embodiments of a second layer of a collimator assembly according to an exemplary embodiment of the invention.
Figure 6:
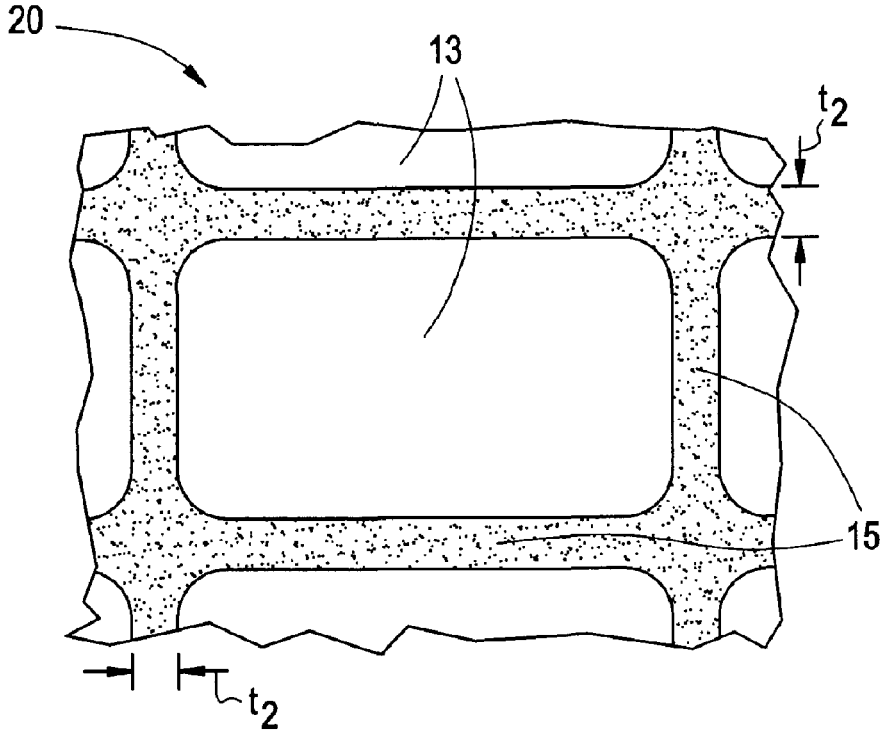

FIGS. 5 and 6 depict views of exemplary embodiments of a second layer 20 of a collimator assembly 100 at different magnifications according to an embodiment of the invention. The second layer 20 includes openings 13 formed by borders 15 formed therein. FIG. 5 shows the openings 13 generally in a square-like pattern and FIG. 6 shows substantially rectangular-shaped openings 13.

The openings 13 of the exemplary embodiment of the second layer 20 shown in FIGS. 5 and 6 may be considered "rough" or "unprecise" as the edges of the borders 15 are substantially uneven and not smooth, for example, when compared to the openings 12 of the first layer 10 discussed above. Further explanation, including forming these "rough" openings 13 and the borders 15 in the second layer 20 will be later discussed in more detail.

As discussed above for the first layer 10, the openings 13 of the second layer 20 may be formed in other shapes, including, but not limited to, rectilinear, hexagonal, octagonal, round, elliptical and the like. The patterned configuration of the openings 13 and borders 15 of the second layer 20 may include rectilinear or diagonal-types, as also discussed above for the first layer 10. That is, the openings 13 of the second layer 20 may be formed substantially commensurately with the openings 12 of the first layer 10 to which the second layer 20 may be attached.

The openings 13 of the second layer 20 formed commensurately with the size and patterned configuration of the openings 12 of the first layer 10, may also be considered "unprecise" because the dimension "$t_2$" of the borders 15 of the second layer 20 may be larger than the dimension "t" of the borders 14 of the first layer 10. Alternatively, the "unprecise" openings 13 of the second layer 20 may be smaller in dimension "$w_2$" than the dimension "w," of openings 12 of the first layer 10. In exemplary embodiments, for example, if the second layer 20 as shown in FIG. 5 were considered "unprecise" as being formed commensurately with the grid 10 shown in FIG. 3, and then the grid 10 were overlayed on the second layer 20, the borders 15 of the second layer 20 may be visible via the openings 12 of the first layer 10.

Figure 7:
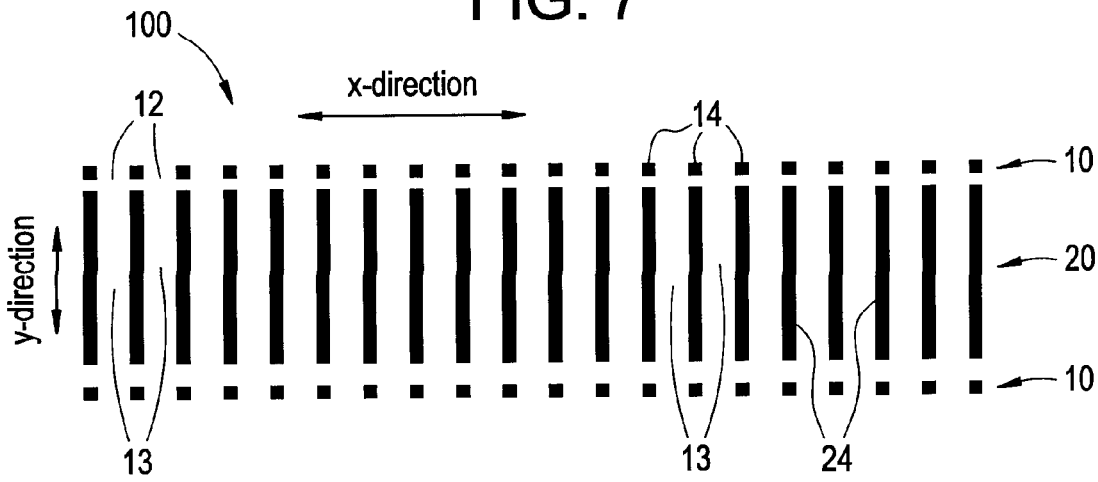
FIG. 7 depicts a cross-sectional view of an exemplary embodiment of a collimator assembly according to an embodiment of the invention.

FIG. 7 shows a cross section of an exemplary embodiment of two of the first layer 10 in an embodiment of the invention, the two of the first layer 10 disposed on opposing sides of the second layer 20. Here, the openings 13 of the formed second layer 20 are shown extending through the thickness of the second layer 20 and substantially aligning with the openings 12 of the first layer 10. These extended openings 13 of the second layer are disposed between columns 24 of second layer 20 material.

The openings 13 through the second layer 20 may be substantially open as shown in the exemplary embodiment of FIG. 7. In alternative embodiments, the openings 13 may include an object 26 located in the openings 13 of the second layer 20, as best shown in an exemplary embodiment of a collimator assembly 100 of another embodiment of the collimator assembly 100 according to an embodiment of the invention in FIG. 8. The object 26 may include a web or an artifact from the forming of the second layer, for example. In other exemplary embodiments, the object 26 may be the result of more than one of the second layer 20 being attached together to form the collimator assembly 100. An object 26 being included somewhere in the extension of the openings 13 of the second layer 20 may be further cause to consider the openings 13 of the second layer 20 or the second layer 20 itself "rough" or "unprecise."

When the first layer 10 and the second layer 20 are attached and the openings 12 and 13, respectively, are aligned as shown in FIG. 7 for example, the openings 12 of the first layer 10 generally delimit the boundary of channels 22 that will be formed in the collimator assembly 100. Referring to FIG. 7, when the aligned openings 12 and 13 of the attached first layer 10 and second layer 20 are viewed from the first layer 10 in the y-direction, there may be material of the second layer 20 that is not "shadowed" by the first layer 10 borders 14, or in other words, material of the second layer 20 that may be observed in the openings 13. As discussed above, this observed material from the "unprecise" second layer 20 may be from the columns 24 of the second layer 20 or may be from an object 26 in the openings 13.

To form the channels 22 of the collimator assembly 100, the material of the second layer 20 observed in the openings 13 of the second layer 20 may be removed as necessary. In embodiments, the more precise first layer 10 may essentially be used as a mask to remove material of the less precise second layer 20 to form the channels 22 of the collimator assembly 100. Subsequent to the removing of the material, the channels 22 extending between openings 12 in the first layer 10 and through the openings 13 of the second layer 20 may be considered "finished" or "precisely" formed. An exemplary embodiment of channels 22 formed after subsequent removal of material of the second layer 20 is best shown in FIG. 1. The forming of the channels 22 by removing material will be later discussed in more detail.

The length of the channels 22 of the collimator assembly 100 may be defined as the overall thickness "T" (in the y-direction) of the collimator assembly, as shown in FIG. 1. In exemplary embodiments, a ratio of the length "T" of the channels 22 to the width, or essentially the opening 12 dimension "w", of the channels 22, may be approximately 5:1 to 40:1. In other exemplary embodiments, the ratio "T/w" may, be approximately 5:1-10:1. In yet other exemplary embodiments, the ratio "T/w" may, be approximately 7:1. A ratio below 5:1 generally does not provide sufficient depth for x-ray collimation, but may be used in alternative embodiments and configurations of the collimator assembly 100 suitable for the purpose disclosed herein and as applications require.

An exemplary embodiment of a method of manufacturing a collimator assembly according to an embodiment of the invention is also provided, where the collimator assembly includes a first layer and a second layer for illustration purposes, as previously discussed. In exemplary embodiments, the first layer may essentially be used as a mask to remove material of the second layer 20 to form channels 22 of the collimator assembly 100.

Referring now to FIG. 7, the first layer 10 and the second layer 20 may be non-removably attached by means including, but not limited to, laminating, diffusion bonding, adhesive bonding, heat bonding, fusing brazing, soldering or any other attaching means suitable for the purposes disclosed herein. As discussed above, the thickness "h" of the first layer 10 may range from about 5% to about 10% of the overall thickness "T" of the collimator assembly 100 after attaching the first layer 10 to the second layer 20. In alternative embodiments, more than one of the first layer 10 and/or one or more of the second layer 20 may be attached to form the collimator assembly 100. For example, the collimator assembly 100 may include a configuration including a first layer 10 attached next to the second layer 20, then another first layer 10, then another second layer 20 and then a final first layer 10.

Once the first layer 10 and the second layer 20 are attached, channels 22 are formed through the first and the second layers, 10 and 20 respectively. The channels 22 may be formed by removing material of the first layer 10 and/or the second layer 20. The removing may include, but is not limited to, chemical etching, plasma etching, chemical milling or like methods suitable for the purpose disclosed herein. The removing of the material forms channels 22 that may be considered "finished" or "precise".

In another exemplary embodiment of a method of forming a collimator assembly according to the invention, the openings 12 in the first layer 10 may be formed before attaching the first layer 10 to the second layer 20. The forming of the first layer 10 openings 12 may include, but is not limited to, laser cutting, etching or chemical milling or any method suitable for the purpose disclosed herein. For example, any of a number of accurate fabricating processes may be used to form the openings 12 in the first layer 10 that achieve the dimensions of the openings 12 and the borders 14, as well as positional requirements of the openings 12 of the first layer 10. In alternative embodiments, the fabrication processes may include methods that are suitable for the materials of the first layer 10 so long as the dimensions, positioning or accuracy of the openings 12 may be achieved. The exemplary embodiments in FIGS. 3 and 4 best show the first layer 10 in a grid-like configuration, after being processed by an accurate forming process, such as laser cutting, etching, for example.

In another exemplary embodiment, the openings 13 of the second layer 20 may be formed before attaching the first layer 10 to the second layer 20. The forming of the second layer 20 openings 13 may include, but is not limited to, casting, etching, molding or any method suitable for the purpose disclosed herein. For example, any of a number of processes may be employed that form the openings 13 of the second layer 20 commensurate with the shape and patterned configuration of the openings 12 of the first layer 10. In alternative embodiments, the forming methods may include processes that are suitable for the materials of the second layer 20 or suitable to form "rough" openings 13 in the second layer 20 commensurate with the shape and patterned configuration of the openings 12 of the first layer 10. The exemplary embodiments in FIGS. 5 and 6 best show the second layer 20 with roughly formed openings 13, for example.

Figure 8:
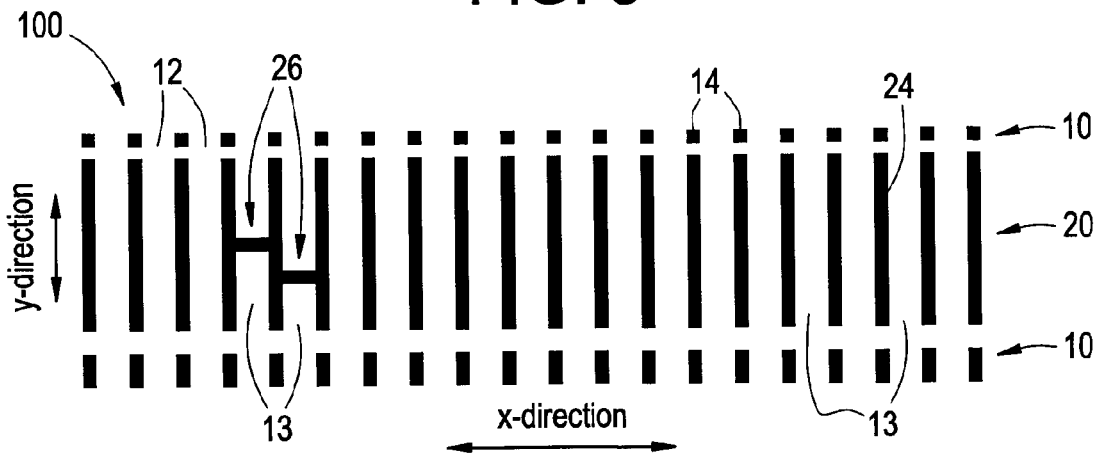
FIG. 8 depicts a cross-sectional view of another exemplary embodiment of a collimator assembly according to an embodiment of the invention.

Referring to FIGS. 7 and 8, openings 12 formed in the first layer 10 and openings 13 formed in the second layer 20, respectively, are substantially aligned. As discussed above, the openings 12 and borders 14 of the first layer 10 may be more precisely formed than the openings 13 and the borders 15 of the second layer 20 by virtue of the forming methods used for the two layers. Material of the columns 24 of the second layer 20 or objects 26 in the openings 13 of the second layer 20 may also be present in the openings 13 of the second layer.

Referring to FIG. 1, once the first layer 10 and the second layer 20 are aligned and attached, channels 22 may be formed through the first and the second layers, 10 and 20, respectively. The channels 22 may be formed by removing material of the first layer 10 and/or the second layer 20. As discussed above, the removing may include any of a number of methods or processes. The openings 12 and the borders 14 of the first layer 10 may essentially be used as a mask for removing the material in the openings 13 of the second layer 20.

After the removing of material of the second layer 20, the shape or profile of the columns 24 of the second layer 20 may be different than that of the columns 24 of the second layer prior to the material removal. For example, the columns 24 of material of the second layer 20 in FIGS. 7 and 8 have a generally rectilinear shape. In comparison, the columns 24 of the second layer 20 after removal of second layer 20 material, as best shown in FIG. 1, include an "hourglass" shape. In alternative embodiments, the profile of the columns 24 after the second layer 20 material removal may include any of a number of other shapes and profiles, including a substantially rectilinear shape, for example.

Materials of the first layer 10 may include, but are not limited to, high atomic number, high density materials or materials suitable for the purpose described herein. For example, the first layer 10 may include tungsten, molybdenum, tantalum, or lead or other high atomic number high density materials. In exemplary embodiments, the first layer 10 may be of any of a number of materials that allow the precise openings 12 and borders 14 of the first layer 10 to be formed in the first layer 10 commensurate with the forming processes discussed above, such as stainless steel or copper or any easily formable material. In other alternative embodiments, the first layer 10 may include materials that would withstand the subsequent process of removing material after the two layers are attached to form the channels 22. In these secondary material removing processes, the first layer 10 may essentially be used as a mask for removing the second layer 20 material. Accordingly, the first layer 10 is required to maintain the configuration and dimensions of its openings 12 and borders 14 while the second layer 20 material is removed.

In exemplary embodiments, the materials of the first layer 10 and the second layer 20 are different materials. The second layer 20 may include any of a number of high atomic number, high density materials or materials suitable for the purpose described herein. For example, the second layer 20 may include tungsten, tantalum, lead or molybdenum. In alternative embodiments, materials may be used that support the forming the openings 13 of the second layer 20 commensurate with the shape and patterned configuration of the openings 12 of the first layer 10. In alternative embodiments, the second layer 20 may include materials that would allowing removing of second layer 20 material during the material removing process to form the channels 22 after the two layers are attached.

Forming the collimator assembly 100 from multiple layers, particularly the forming of the "thicker" second layer by less precise (and less costly) methods than the first layer, achieves a required aspect ratio (T/L) for the collimator assembly 100 in a cost effective way. Essentially, an exemplary embodiment of the method discussed above, reduces the forming and/or material removing steps to achieve an overall cost advantage.

For example, when the thin first layer 10 is accurately pre-formed and attached to the roughly formed thicker second layer 20, the first layer 10 may essentially be used as a mask to remove material of the second layer 20 to form accurate finished channels 22. In this exemplary method, there is an added overall cost benefit to manufacture the collimator assembly 100 because the removing of material in pre-formed openings 13 of the second layer 20 under the precise openings 12 of the first layer may be accomplished at a lower cost than forming channels 22 through one or more solid layers.

In another exemplary embodiment, since the accurately pre-formed formed first layer 10 may be secured at a cost advantage as described above, the first layer 10 may be detached from the second layer 20 after the forming of the finished channels 22. Here, the second thicker layer 20 itself may be the finished collimator assembly 100. The first layer 10 and the second layer 20 in this embodiment may be removably attached by method including temporary adhesive, temporary bonding, or the like, as well as any method suitable for the purposes disclosed herein.

As an added benefit, since forming processes of the first layer 10 and/or the second layer 20 may be done prior to attachment to the second layer 20 to the first layer 10, the manufacturability of the collimator assembly 100 may be made modular for a further cost advantage. For example, instead of a one piece first layer 10, the first layer 10 may include a number of individual pieces, such as tiles.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A method of fabricating a collimator assembly, the collimator assembly including a first layer and a second layer, the method comprising:

attaching the first layer to the second layer, thereby defining an overall thickness, wherein a thickness of the first layer ranges from about 5% to about 10% of the overall thickness, wherein said first layer and said second layer are formed from materials having an atomic number of at least 42, and wherein said overall thickness is sufficiently thick to shield a scintillator; and subsequent to the attaching, forming channels through the first layer and the second layer.

2. The method according to claim 1, wherein said attaching comprises laminating, diffusion bonding, adhesive bonding, heat bonding/fusing brazing, soldering, or any combination including at least one of the foregoing.

3. The method according to claim 1, wherein said forming channels comprises chemical etching, plasma etching, chemical milling, drilling, blasting, grinding or any combination including at least one of the foregoing.

4. The method according to claim 1, further comprising detaching the first layer from the second layer, said detaching leaving the second layer as a finished collimator assembly.

5. The method according to claim 1, wherein the first layer comprises a grid.

6. The method according to claim 1, wherein the channels comprise a channel length defined by the overall thickness, the channels further comprising a channel width, wherein an aspect ratio of the channel length to the channel width is approximately 5:1 to 10:1.

7. The method according to claim 1, further comprising forming openings in the first layer before said attaching.

8. The method according to claim 7, further comprising:

forming openings in the second layer before the attaching; and, wherein said forming channels comprises removing material in the openings of the second layer via the openings of the first layer.

9. A method of fabricating a collimator assembly, the collimator assembly including a first layer and a second layer, the method comprising:

forming openings in the first layer;

attaching the first layer to the second layer, thereby defining an overall thickness, wherein a thickness of the first layer ranges from about 5% to about 10% of the overall thickness;

subsequent to the attaching, forming channels through the first layer and the second layer, said forming comprising using the first layer as a mask to remove material, the second layer; and, forming openings in the second layer before said attaching.

10. The method according to claim 9, further comprising aligning the openings of the first layer with the openings of the second layer.

11. The method according to claim 9, wherein said forming channels comprises removing material in the openings of the second layer via the openings of the first layer.

12. A method of manufacturing a collimator assembly for use with a high energy imaging system, the collimator assembly including an external layer and an internal layer, the method comprising:

configuring holes in the external layer and the internal layer;

subsequent to the configuring holes, joining the external layer to the internal layer;

subsequent to the joining, removing a part of the internal layer via the holes of the external layer, said removing fabricating channels through the external layer and the internal layer.

13. The method according to claim 12, wherein said configuring holes in the external layer comprises laser cutting, etching, chemical milling or any combination including at least one of the foregoing.

14. The method according to claim 12, wherein the configuring holes in the external layer comprises configuring external layer holes such that an external layer hole height is defined by a thickness of the external layer, and an external layer hole width is defined by an overall width of the external layer hole, and wherein a ratio of the external layer hole height to the external layer hole width ranges from about 1:1 to about 1:4.

15. The method according to claim 12, wherein said configuring holes in the internal layer comprises casting, etching, drilling, molding or any combination including at least one of the foregoing.

16. The method according to claim 12, wherein the external layer comprises a plurality of tiles, a grid or any combination including at least one of the foregoing.

17. The method according to claim 12, wherein said joining comprises joining together more than one of the external layer, the internal layer or both layers.

18. The method according to claim 12, wherein said joining comprises aligning the holes of the first layer with the holes of the second layer.

19. The method according to claim 12, wherein said joining of the external layer to the internal layer defines an overall thickness, wherein the external layer comprises an external layer thickness ranging from about 5% to about 10% of the overall thickness.

* * * * *

UNITED STATES PATENT AND TRADEMARK OFFICE

CERTIFICATE OF CORRECTION

PATENT NO. : 7,615,161 B2
APPLICATION NO. : 11/161867
DATED : November 10, 2009
INVENTOR(S) : David Michael Hoffman It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 681 days.

Signed and Sealed this

Nineteenth Day of October, 2010

David J. Kappos

David J. Kappos
*Director of the United States Patent and Trademark Office*